US006001779A

United States Patent [19]

Yamaguchi

[11] Patent Number: 6,001,779

[45] Date of Patent: Dec. 14, 1999

[54] LUBRICATING OIL COMPOSITION HAVING AN ASHLESS WEAR INHIBITOR

[75] Inventor: Elaine S. Yamaguchi, El Cerrito, Calif.

[73] Assignee: Chevron Chemical Company LLC, San Francisco, Calif.

[21] Appl. No.: 08/118,377

[22] Filed: Sep. 8, 1993

[51] Int. Cl.[6] ..... C10M 133/12

[52] U.S. Cl. ..... 508/189; 508/375

[58] Field of Search ..... 252/32.7 E, 51.5 R

[56] References Cited

U.S. PATENT DOCUMENTS

| | | | |
|---|---|---|---|
| 4,320,020 | 3/1982 | Lange | 252/51.5 R |
| 4,320,021 | 3/1982 | Lange . | |
| 4,379,065 | 4/1983 | Lange . | |
| 4,386,939 | 6/1983 | Lange . | |
| 4,466,895 | 8/1984 | Schroeck | 252/327 E |

FOREIGN PATENT DOCUMENTS

| | | |
|---|---|---|
| 144394 | 12/1983 | Japan . |
| 182787 | 1/1989 | Japan . |
| 9221736 | 12/1992 | WIPO . |

*Primary Examiner*—Margaret Medley
*Assistant Examiner*—Cephia D. Toomer
*Attorney, Agent, or Firm*—S. G.K. Lee; E. A Schaal

[57] ABSTRACT

A lubricating oil composition has an oil of lubricating viscosity, plus minor portions of alkylated aminophenol and zinc dithiophosphate. Preferably, about 75 mol % of the alkyl groups of the zinc dithiophosphate are derived from primary alcohols. The alkylated aminophenol can be a borated 4-alkyl-2-aminophenol having, as its alkyl group, a polypropylene tetramer having from 18 to 30 carbon atoms.

1 Claim, 1 Drawing Sheet

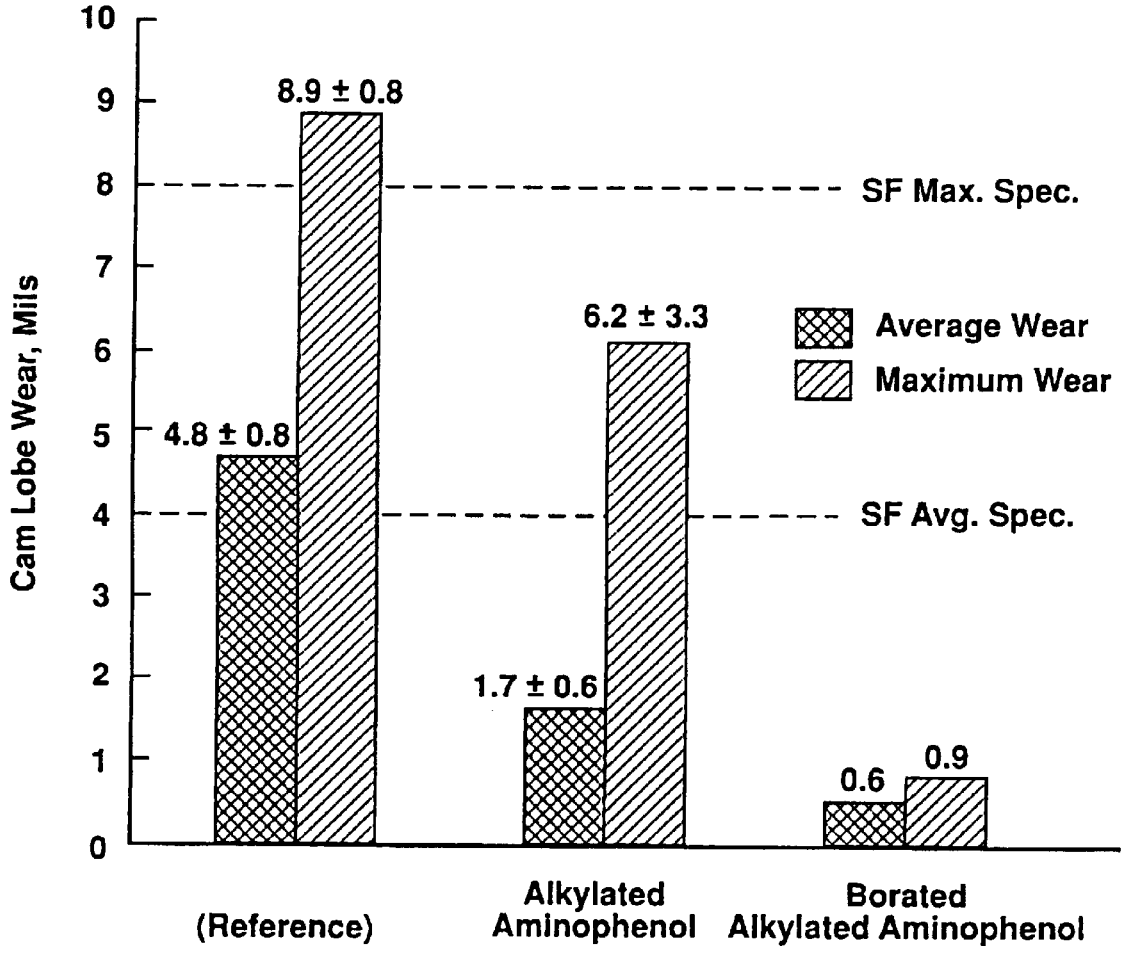
Cam Lobe Wear, Mils
10
9
8
7
6
5
4
3
2
1
0
8.9 ± 0.8
4.8 ± 0.8
6.2 ± 3.3
1.7 ± 0.6
0.6
0.9
SF Max. Spec.
SF Avg. Spec.
Average Wear
Maximum Wear
(Reference)
Alkylated Aminophenol
Borated Alkylated Aminophenol

LUBRICATING OIL COMPOSITION HAVING AN ASHLESS WEAR INHIBITOR

The present invention relates to a lubricating oil composition having an improved ashless wear inhibition.

BACKGROUND OF THE INVENTION

One of the primary purposes of the crankcase oil is to prevent engine wear. The wear requirements for crankcase oils will become more stringent during the 1990's. Gasoline engine manufacturers are requesting lower phosphorus oils to prevent catalyst and oxygen sensor deactivation, while still maintaining minimum valve train wear.

One obvious approach is to take advantage of the powerful wear inhibiting properties of the zinc dialkyl dithiophosphates (ZnDTP) that constitute the major wear inhibiting additives in modern crankcase formulations. In particular, zinc dialkyl dithiophosphates can be primary alcohol derived or secondary alcohol derived. In recent studies, S. H. Roby of Lubrizol, reported that secondary alcohol-derived ZnDTP appears to moderate abrasion, fatigue, and pitting wear rates. See "Investigation of Sequence IIIE Valve Train Wear Mechanism," Lubr. Eng., 47, 5, pp 413–422 (1991). The primary alcohol-derived ZnDTP formulation was not effective in reducing valve train wear in full-length 64 hour Sequence IIIE engine tests. These studies were done at current phosphorus levels of 0.11–0.13%.

One possible approach would be to maximize the amount of secondary alcohol-derived ZnDTP in the formulation for effective wear protection at low phosphorus levels. It is conceivable, however, that this approach might someday become impractical, when the wear inhibiting properties of the secondary alcohol-derived ZnDTPs become ineffective at increasingly lower phosphorus levels.

Another, equally plausible approach, is to boost the valve train wear performance of the primary alcohol-derived ZnDTP with ashless, nonphosphorus-containing inhibitors. In this approach, one adds a new inhibitor to a baseline formulation containing primary alcohol-derived ZnDTP. The combined effect should turn a marginal wear inhibiting package into a package with good valve train wear protection. In addition, the relative thermal stability of the primary ZnDTP versus the secondary ZnDTP maintains strong oxidation inhibition characteristics. Such cost/performance properties are a prime consideration for formulating oils.

It is well known that hydrocarbon oils are partially oxidized when contacted with oxygen at elevated temperatures for long periods. The internal combustion engine is a model oxidator, since it contacts a hydrocarbon motor oil with air under agitation at high temperatures. Also, many of the metals (iron, copper, lead, nickel, etc.) used in the manufacture of the engine and in contact with both the oil and air, are effective oxidation catalysts, which increase the rate of oxidation. The oxidation in motor oils is particularly acute in the modern internal combustion engine that is designed to operate under heavy work loads and at elevated temperatures.

The oxidation process produces acidic bodies within the motor oil that are corrosive to typical copper and lead engine bearings. It has also been discovered that the oxidation products contribute to piston ring sticking, the formation of sludge within the motor oil, and an overall breakdown of viscosity characteristics of the lubricant.

Several effective oxidation inhibitors have been developed and are used in almost all of the conventional motor oils today. Typical of these inhibitors are the sulfurized oil-soluble organic compounds, such as aromatic or alkyl sulfides and polysulfides, sulfurized olefins, sulfurized carboxylic acid esters, and sulfurized ester-olefins, as well as the oil-soluble phenolic and aromatic amine antioxidants. These inhibitors, while exhibiting good antioxidant properties, are burdened by economic and oil contamination problems.

It is therefore natural that modern formulations rely on zinc dithiophosphates to improve their load-bearing properties, such as extreme pressure and antiwear properties, and oxidation inhibition.

ZnDTP is one of the metal salts of dihydrocarbyl dithiophosphoric acids. Metal salts of dihydrocarbyl dithiophosphoric acids are well known as load-bearing additives for lubricating oils. Such salts may be represented by the formula:

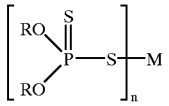

wherein:

R is the same or different optionally substituted hydrocarbyl group;

M is a metal, and n corresponds to the valence of the metal M.

Many types of metal salts of dihydrocarbyl dithiophosphoric acids have been proposed. U.S. Pat. Nos. 2,410,642, 2,540,084, and 4,212,751, and U.K. Patents 723,133 and 852,365 proposed those in which the optionally substituted hydrocarbyl groups represented by R are the same or different alkyl, cycloalkyl, aryl groups. U.S. Pat. Nos. 3,102,096 and 4,288,335, and U.K. Patent 2,070,054 disclose groups derived from alkoxylated alcohols and monoester alcohols.

U.S. Pat. No. 4,466,895 discloses metal salts of one or more dialkyl phosphorodithioic acids where a mixture of primary and secondary alcohols is used as a starting material, and the total number of carbon atoms per phosphorus atoms is less than 8. Preferably, n-butyl and isopropyl alcohols are used in this invention.

Zinc dithiophosphates can be derived from primary alcohols, secondary alcohols, and phenols. Zinc dithiophosphates derived from primary or secondary alcohols have certain advantages over the alkaryl type of zinc dithiophosphate. These advantages include (1) good antiwear properties in 0.10–0.14% P-containing oils, if properly formulated, and (2) relatively cheap oxidation inhibition properties. While primary alcohol-derived zinc dithiophosphates are more thermally stable than secondary alcohol-derived zinc dithiophosphates, primary alcohol-derived zinc dithiophosphates have the disadvantage of not being as effective in valve train wear inhibition as the secondary alcohol-derived zinc dithiophosphates. This could be a real problem in the low phosphorus oil environment ahead.

SUMMARY OF THE INVENTION

The present invention provides a lubricating oil composition having improved ashless wear inhibition. That composition has a major portion of at least one oil of lubricating viscosity, a minor portion of an alkylated aminophenol, and a minor portion of zinc dithiophosphate derived from primary alcohols. The alkylated aminophenol enhances the performance of the zinc dithiophosphate so that at least 75 mol % of the alkyl groups of the zinc dithiophosphate can be derived from primary alcohols. Preferably, all of the alkyl groups of the zinc dithiophosphate are derived from primary alcohols.

Preferably, the alkyl group of the alkylated aminophenol is a polypropylene tetramer having from 18 to 30 carbon atoms. Preferably, the alkylated aminophenol is a 4-alkyl-2-aminophenol. The aminophenol can be borated to further increase ashless wear inhibition.

BRIEF DESCRIPTION OF THE DRAWINGS

In order to assist the understanding of this invention, reference will now be made to the appended drawings. The drawings are exemplary only, and should not be construed as limiting the invention.

FIG. 1 shows a plot of wear inhibition for various combinations of zinc dithiophosphates and alkylated aminophenols.

DETAILED DESCRIPTION OF THE INVENTION

In its broadest aspect, the present invention involves a lubricating oil composition having a major portion of at least one oil of lubricating viscosity, a minor portion of an alkylated aminophenol, and a minor portion of zinc dithiophosphate, wherein more than 50 mol % of the alkyl groups of the zinc dithiophosphate are derived from primary alcohols.

Lubricating Oil

Suitable lubricating oils that can be used to prepare lubricating oil compositions or concentrates of this invention are oils of lubricating viscosity derived from petroleum or synthetic sources. The oils can be paraffinic, naphthenic, halo-substituted hydrocarbons, synthetic esters, polyolefins or combinations thereof. Oils of lubricating viscosity have viscosities in the range from 35 to 50,000 SUS at 100° F., and more usually from about 50 to 10,000 SUS at 100° F.

Preferably, the oil basestock is a lubricating oil, fractions of a mineral oil such as petroleum, either naphthenic, paraffinic or as mixed naphthenic/paraffinic base, unrefined, acid-refined, hydrotreated or solvent refined as required for the particular lubricating need. In addition, synthetic oils such as ester lubricating oils and polyalphaolefins, as well as mixtures thereof with mineral oil meeting the viscosity requirements for a particular application either with or without viscosity index improvers may also be used as basestock provided the above compound is soluble therein. The lubricating oil basestock preferably will have a viscosity in the range from about 44 to about 1,000 SUS at 100° F. Suitable mineral oils include low, medium, high and very high viscosity index lubricating oils.

Aminophenol

As mentioned above, the invention of the present invention includes an alkylated aminophenol.

U.S. Pat. Nos. 4,320,020 and 4,320,021 relate to aminophenols and their use in lubricants. Aminophenols have been used in combination with dispersants and detergents. U.S. Pat. No. 4,379,065 issued to Lange relates to aminophenols used in combination with ashless ester dispersants.

U.S. Pat. No. 4,320,020, entitled "Alkyl Amino Phenols And Fuels And Lubricants Containing Same," discloses aminophenols of the formula:

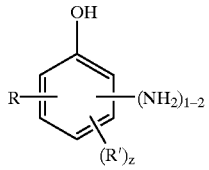

where

R is a substantially saturated hydrocarbyl substituent having from 30 to 750 aliphatic carbon atoms;

R' is a substituent selected from the group consisting of lower alkyl, lower alkoxyl, nitro, and halo; and z is 0 or 1.

U.S. Pat. No. 4,320,020 is hereby incorporated by reference for all purposes.

Both U.S. Pat. No. 4,320,021, entitled "Amino Phenols Useful As Additives For Fuels And Lubricants," and U.S. Pat. No. 4,379,065, entitled "Amino Phenols In Combination With Ashless Ester Dispersants As Useful Additives For Fuels And Lubricants," disclose aminophenols of the formula:

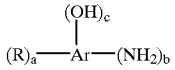

where

R is a substantially saturated hydrocarbon group having at least 30 aliphatic carbon atoms;

a, b, and c are each 1, 2, or 3; and

Ar is an aromatic moiety such as a benzene nucleus, naphthalene nucleus, or linked benzene nucleus.

Both U.S. Pat. No. 4,320,021 and U.S. Pat. No. 4,379,065, are hereby incorporated by reference for all purposes.

Preferably, the aminophenol is represented by the formula

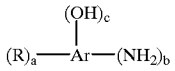

where

R is a hydrocarbyl substituent having an average of about 10 up to about 400 carbon atoms;

a, b, and c are each independently an integer from 1 up to 3 times the number of aromatic nuclei present in Ar with the proviso that the sum of (a) plus (b) plus (c) does not exceed the unsatisfied valences of Ar; and Ar is an aromatic moiety which is substituted by from 0 to 3 substituents selected from the group consisting of lower alkyl, alkoxyl, nitro, halo or combinations of two or more thereof.

The number of aromatic nuclei, fused, linked or both, in the above described Ar can play a role in determining the integer values of a, b and c. For example, when Ar contains a single aromatic nucleus, a, b and c are each independently 1 to 3. When Ar contains two aromatic nuclei, a, b and c can each be an integer from 1 to 6, that is, up to three times the number of aromatic nuclei present (in naphthalene, 2). With a tri-nuclear aromatic moiety (Ar), a, b and c can each be an integer of 1 to 9. For instance, when Ar is a biphenyl or a naphthyl moiety, a, b and c can each independently be an integer of 1 to 6. The values of a, b and c are limited by the fact that their sum cannot exceed the total unsatisfied valences of Ar.

The phenolic compounds used in the present invention contain, directly bonded to the aromatic moiety Ar, a hydrocarbyl group (R) of at least about 10 aliphatic carbon atoms. Unlike the aminophenols of U.S. Pat. Nos. 4,320,020; 4,320,021; and 4,379,065; which all have alkyl groups in excess of 30 carbon atoms, the alkyl group of the alkylated aminophenol of the present invention preferably has from 18 to 30 carbon atoms. The reason the alkyl group should have from 18 to 30 carbon atoms is that the alkylated aminophenol of the present invention needs to be soluble in oil, yet still maintain surface adsorption properties to enhance the adsorption of the primary alcohol-derived zinc dithiophosphate onto the engine surfaces. If the alkyl group has more than 30 carbon atoms, it will be more soluble in the oil and therefore have less tendency to adsorb on the surfaces.

Illustrative hydrocarbyl groups containing at least ten carbon atoms are n-decyl, n-dodecyl, tetrapropenyl, n-octadecyl, oleyl, chlorooctadecyl, triicontanyl, etc. Generally, the hydrocarbyl groups R are derived from polyalkenes. The polyalkenes are homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins. The R groups can also be derived from the halogenated (e.g., chlorinated or brominated) analogs of such polyalkenes. The R groups, however, can be derived from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., polyethylene greases) and other sources known to those skilled in the art. Any unsaturation in the R groups may be reduced or eliminated by hydrogenation according to procedures known in the art.

Preferably, the alkyl group of the alkylated aminophenol is a polypropylene tetramer. Polypropylene tetramers are preferred because of the branching. They will be soluble and not wax out.

The attachment of the hydrocarbyl group R to the aromatic moiety Ar of the aminophenols used in this invention can be accomplished by a number of techniques well known to those skilled in the art. One particularly suitable technique is the Friedel-crafts reaction, wherein an olefin (e.g., a polymer containing an olefinic bond, or halogenated or hydrohalogenated analog thereof) is reacted with a phenol. The reaction occurs in the presence of a Lewis acid catalyst (e.g., boron trifluoride and its complexes with ethers, phenols, hydrogen fluoride, etc., aluminum chloride, aluminum bromide, zinc dichloride, etc.). Methods and conditions for carrying out such reactions are well known to those skilled in the art. See, for example, the discussion in the article entitled, "Alkylation of Phenols" in Kirk-Othmer "Encyclopedia of Chemical Technology," Second Edition, Vol. 1, pages 894–895, Interscience Publishers, a division of John Wiley and Company, N.Y., 1963. Other equally well known appropriate and convenient techniques for attaching the hydrocarbon-based group R to the aromatic moiety Ar will occur readily to those skilled in the art.

As mentioned, the aromatic moiety (Ar) may contain up to 3 optional substituents that are lower alkyl, lower alkoxyl, carboalkoxy methylol or lower hydrocarbon-based substituted methylol, nitro, nitroso, halo, amino, or combinations of two or more of these optional substituents. These substituents may be attached to a carbon atom that is part of the aromatic nucleus in Ar. They need not, however, be attached to the same aromatic ring if more than one ring is present in Ar. The preferred aminophenol of the present invention comprises a 4-alkyl-2-aminophenol.

The aminophenols of the present invention can be prepared by a number of synthetic routes. For example, an aromatic hydrocarbon or a phenol may be alkylated and then nitrated to form an intermediate. The intermediate may be reduced by any means known to those in the art.

The preferred aminophenol, 4-alkyl-2-aminophenol, can be produced by nitration and reduction of a 4-alkylphenol, such as shown below:

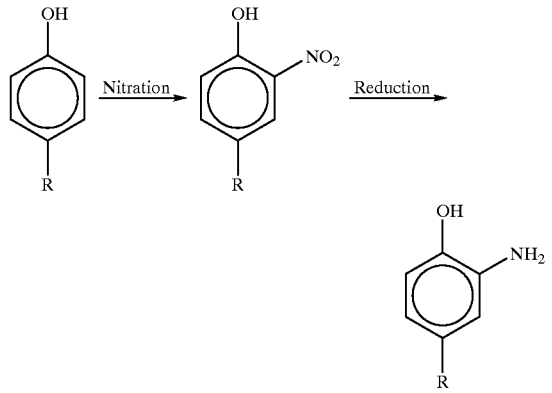

where R is an alkyl group.

Techniques for nitrating phenols are known. See, for example, in Kirk-Othmer "Encyclopedia of Chemical Technology," Second Edition, Vol. 13, the article entitled "Nitrophenols," page 888 et seq., as well as the treatises "Aromatic Substitution; Nitration and Halogenation" by P. B. D. De La Mare and J. H. Ridd, N.Y., Academic Press, 1959; "Nitration and Aromatic Reactivity" by J. G. Hogget, London, Cambridge University Press, 1961; and "The Chemistry of the Nitro and Nitroso Groups," Henry Feuer, Editor, Interscience Publishers, N.Y., 1969.

Reduction of aromatic nitro compounds to the corresponding amines is also well known. See, for example, the article entitled "Amination by Reduction" in Kirk-Othmer "Encyclopedia of Chemical Technology," Second Edition, Vol. 2, pages 76–99. Generally, such reductions can be carried out with, for example, hydrogen, carbon monoxide or hydrazine, (or mixtures of same) in the presence of metallic catalysts such as palladium, platinum and its oxides, nickel, copper chromite, etc. Co-catalysts such as alkali or alkaline earth metal hydroxides or amines (including aminophenols) can be used in these catalyzed reductions.

Nitro groups can also be reduced in the Zinin reaction, which is discussed in "Organic Reactions," Vol. 20, John Wiley & Sons, N.Y., 1973, page 455 et seq. Generally, the Zinin reaction involves reduction of a nitro group with divalent negative sulfur compounds, such as alkali metal sulfides, polysulfides and hydrosulfides.

The nitro groups can be reduced by electrolytic action. See, for example, the "Amination by Reduction" article, referred to above.

Typically the aminophenols used in this invention are obtained by reduction of nitrophenols with hydrazine or hydrogen in the presence of a metallic catalyst such as discussed above. This reduction is generally carried out at temperatures of about 15°–250° C., typically, about 50°–50° C. When using hydrogen, the hydrogen pressures are about 0–2000 psig, typically, about 50–250 psig. The reaction time for reduction usually varies between about 0.5–50 hours. Substantially inert liquid diluents and solvents, such as ethanol, cyclohexane, etc., facilitate the reaction. The aminophenol product is obtained by well-known techniques such as distillation, filtration, extraction, etc.

The reduction is carried out until at least about 50%, usually about 80%, of the nitro groups present in the nitro intermediate mixture are converted to amino groups. The typical route to the aminophenols of this invention just described can be summarized as (I) nitrating with at least one nitrating agent and (2) reducing at least about 50% of the nitro groups in the first reaction mixture to amino groups.

The alkylated aminophenol can be borated. One reason why the alkylated aminophenol might be borated is that boric acid can react with the aminophenol to produce materials that further enhance wear inhibition of the entire additive package, thereby transforming a marginally effective additive package to an excellent one. Another reason for borating the alkylated aminophenol is that boration can help reduce negative side effects, such as Cu/Pb bearing corrosion, often associated with organic amines.

Zinc Dithiophosphate

The general methods for preparing the dithiophosphoric acid esters and their corresponding metal salts are described in U.S. Pat. Nos. 3,089,850, 3,102,096, 3,293,181 and 3,489,682, which are all incorporated by reference for all purposes.

Examples of metal compounds that may be reacted with the dithiophosphoric acid to produce zinc dithiophosphate include zinc oxide, zinc hydroxide, zinc carbonate, zinc propylate.

The total amount of the zinc dithiophosphate present is in the range of 3 to 30, preferably 15 to 25, millimoles of zinc per kilogram of finished product. The reason for this range is that less than 15 mm/kg could easily result in failing valve train wear performance, while greater than 25 mm/kg leads to the problem of phosphorus poisoning of the catalytic converters, so low phosphorus oils are desired.

More than 50 mol % of the alkyl groups of the zinc dithiophosphate are derived from primary alcohols. Primary alcohol-derived zinc dithiophosphates give cheap, effective oxidation inhibition, as compared to secondary alcohol-derived zinc dithiophosphates, while providing a moderate level of valve train wear protection.

Preferably, about 75 mol % of the alkyl groups of the zinc dithiophosphate are derived from primary alcohols.

This invention differs from others, such as U.S. Pat. No. 4,466,895, because it prefers to use zinc dithiophosphates derived from primary alcohols only. The antiwear performance of the primary alcohol-derived zinc dithiophosphate is improved by combining it with another material, the aminophenol in this instance, that does not increase the overall phosphorus level or the ash content of the oil.

The amount of additive present in the composition may vary between wide limits but is suitably from 0.01 to 10% by weight with amounts of from 0.1 to 2% by weight being usual, based on the weight of the composition.

The lubricating compositions according to the invention may contain other components. Examples of such components include viscosity-index improvers including conjugated diolefin block copolymers and low molecular weight methacrylate polymers, dispersants (of the ash and/or ashless type), pour point depressants such as acrylate and methacrylate polymers, antioxidants, metal passivators and anti-corrosion agents. If desired, in addition to the present load-bearing additives, the lubricating composition may include other compounds having a load-bearing action.

Additive concentrates are also included within the scope of this invention. They usually include from about 90 to 10 weight percent of an oil of lubricating viscosity and are normally formulated to have about 10 times the additive concentration that would be used in the finished lubricating oil composition. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions.

Suitable lubricating oils that can be used as diluents typically have viscosities in the range from about 35 to about 500 Saybolt Universal Seconds (SUS) at 100° F. (38° C.), although any oil of lubricating viscosity can be used.

Other conventional additives that may also be used in combination with this invention include oxidation inhibitors, antifoam agents, rust and corrosion inhibiting agents, viscosity index improvers, pour-point depressants, and the like. These include such compositions as chlorinated wax, benzyl disulfide, sulfurized sperm oils, sulfurized terpene, phosphorus esters such as trihydrocarbon phosphites, metal thiocarbamates such as zinc dioctyldithiocarbamate, polyisobutylene having an average molecular weight of 100,000, etc.

The lubricating oil compositions of the invention are especially useful for lubricating internal combustion engines.

EXAMPLES

The invention will be further illustrated by following examples, which set forth particularly advantageous method embodiments. While the Examples are provided to illustrate the present invention, they are not intended to limit it.

Example 1

Synthesis of Primary Alcohol-Derived Dithiophosphoric Acid

About one-third of the total 2-ethyl-1-hexanol (2 EH) was placed in a three-neck round bottom flask and chilled to 0° C., with an ice slurry. The 2 EH was stirred for 5 minutes to ensure proper cooling. During this time, a stoichiometric charge of $P_2S_5$ was weighed out. The $P_2S_5$ was added to the three-neck flask using a funnel. The flask was then equipped with a water-cooled condenser and a dropping funnel attached to a micropump. All the $P_2S_5$ was added to the flask. The $H_2S(g)$ was vented to a scrubber (25% sodium hydroxide solution). There was a slight nitrogen sweep over the reaction. The remainder of the 2 EH was added over a 2-hour time period once the temperature exotherm had ceased, during which time the temperature was raised slowly to 99° C. The reaction was held at 99° C. for 4.5 more hours once the 2 EH was completely added to the reactor. The finished dithiophosphoric acid (DTPA) product was filtered through a Whatman paper filter to get rid of any residual $P_2S_5$. It is very important to sparge the product with nitrogen for about 1 to 8 hours to rid the product of excess $H_2S(g)$. This was carried out and testing of the DTPA for $H_2S(g)$ was done with lead acetate test paper. Acid number of the product was 141.24 mg KOH/g and 31 P NMR confirmed the primary alcohol-derived nature of the product having the formula:

DTPA

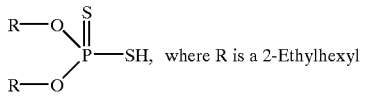

Example 2

Synthesis of Primary Alcohol-Derived Zinc Dithiophosphate

The above product (DTPA) (~100 g) was placed in a 250-mL three-neck round bottom flask. The temperature was maintained by a temperature controller, which in turn controlled a heating mantle. ZnO (30% excess) was added in a single dump to a mechanically stirred slurry of DTPA and acetic acid (2% by weight of the weight of ZnO) under a nitrogen blanket. After 6 hours of heating at 77° C., the mixture was stripped at 95° C. for 1 hour and under high vacuum (1–5 mm Hg). A sample was taken for sediment analysis, while the rest of the mixture was filtered through a ¼-in. thick pad of celite, with the aid of a heat lamp. A 31 P NMR spectrum showed the ZnDTP product. Standard chemical analysis showed % P=7.6%, % S=14.3, % Zn=9.15.

Example 3

Synthesis of Nitrated Alkylated Phenol

An alkylated phenol (7594 g) and methylene chloride (6 liters) were charged to a 22 liter flask, which was set up with a stirrer, thermometer addition funnel, reflux condenser, and an ice bath. A mixture of nitric acid/sulfuric acid (2272.8 g/3753.6 g) was added to the cooled reaction flask (temperature below 40° C.) in a dropwise manner through an addition funnel over a 2¼ hr period. The ice bath was removed and the reaction was allowed to stir at room temperature for 1 hour. A heating mantle was placed under the flask, and a temperature probe/controller replaced the thermometer. The reaction was heated to reflux and held for 1.5 hours. The methylene chloride was stripped off, and the product was transferred to a 50-liter flask equipped with a stirrer and reflux condenser. Diethyl ether (18 liters) was added to the flask, with mixing. The aqueous acid layer was drained off using a vacuum flask and suction tube. Water (8000 mL) was added with stirring. Again, the aqueous layer was removed. This was repeated twice, followed by addition of 5% aqueous NaHCO3 solution (8000 mL). Some emulsion problem was noted as the aqueous layer (~1500 mL) was removed. NaCl (100 g) and water (2000 mL) were added with stirring. After removing the aqueous layer, the emulsion was broken, whereupon separation of the aqueous layer occurred. This layer was removed, leaving an organic layer that was dried over anhydrous MgSO4 and then filtered. The product was stripped. An IR showed the presence of the nitro group at ~1600 $cm^{-1}$ and 1300 $cm^{-1}$. Standard chemical analysis showed % C=75.17, % H=11.01, % N=3.24; expected % C=75.43, % H=11.13, % N=3.03.

Example 4

Synthesis of Alkylated Aminophenol

The product from the previous example (850 g) was mixed with 200 proof ethanol (1000 g) and charged to a 1 gallon autoclave. Nickel/Kieselguhr catalyst (105 g) was added and the mixture was stirred with a spatula. The autoclave was sealed and the head bolts were torqued to 170 ft-lb. The system was pressure tested to 1500 psi with argon, then purged with argon to 500 psi, 750 psi, 1000 psi, and 1200 psi. Next, the autoclave was purged with hydrogen to 500 psi, 800 psi, 900 psi, and 1000 psi. The autoclave was pressured to 300 psi with hydrogen, and the hydrogenation was started. The autoclave was heated to 150° C. and the hydrogen pressure was adjusted to 500 psi. The temperature was controlled at 150–160° C. by turning on the cooling water during the hydrogenation. After the system had experienced the theoretical change in pressure, the run was stopped. The top plug on the autoclave was removed and hexane (1500 mL) was added. The plug was replaced, and the contents of the autoclave was heated to 45–60° C. and pressured to ~300 psi with argon. The contents of the autoclave was removed by pressuring out of the "blow tube." The reaction mixture was filtered through SSC, giving a filtrate that was put in a 3-liter flask. The filtrate was stripped at 85° C. under 0.3 mm of Hg vacuum and held for 15 minutes. Product (alkylated aminophenol) was obtained (770 g). Standard chemical analysis showed % C=80.49, % H=12.10, % N=3.09; expected % C=80.0, % H=12.0, % N=3.0.

Example 5

Synthesis of Borated Alkylated Aminophenol

An alkylated aminophenol (816 g) was charged to a 3-liter, three-necked round bottom flask and mixed well with 1000 ml of toluene. The flask was equipped with a stirrer, nitrogen purge, temperature probe/controller, heating mantle, dean-stark trap and a reflux condenser. Boric acid (124 g) was added to the flask through a powder funnel. The reaction mixture was heated to reflux at 95° C. over a period of 1.5 hours. Over the next 4.5 hours, 55 ml of $H_2O$ was removed; and the temperature went up to 100° C. The reaction mixture was filtered through standard celite, and stripped to 120° C. under 0.5 of Hg vacuum to give 832 grams. Standard chemical analysis showed % C=73.90, % H=11.20, % N=3.02; % B=2.34; expected % C=72.4, % H=11.5, % N=3.1, % B=2.4.

Example 6

Engine Test

In order to decrease exhaust catalyst poisoning, future passenger car crankcase oil formulations may be limited to lower phosphorus levels. Consequently, we studied gasoline engine valve train wear in the Sequence IIID Screener engine test at 0.08% P levels. Formulated oils containing the additives shown in Table 1 were prepared and tested in Sequence IIID Screener, a variation of a Sequence IIID test method (according to ASTM Special Technical Publication 315H). The baseline formulation contained 0.08% as primary alkyl zinc dithiophosphate, 30 millimoles/kg Ca as calcium phenate, 10 millimoles/kg Mg as magnesium sulfonate, 3.5% of a nitrogen-containing dispersant, 8% of an olefin copolymer V.I. improver in Exxon base oils. Formulations were prepared by adding each of the components directly to the oil. Note that a low phosphorus formulation was chosen as the baseline with the intent of producing a high wear oil.

TABLE I

| Sequence IIID Screener Test Results | | |
|---|---|---|
| | Wear, Mils | |
| Additive 1% | Average | Maximum |
| None (Reference) | 4.8 ± 0.8 | 8.9 ± 0.8 |
| Alkylated Amino Phenol (Example 4) | 1.7 ± 0.6 | 6.2 ± 3.3 |
| Borated Alkylated Amino Phenol (Example 5) | 0.6 | 0.9 |

The purpose of the Screener test is to determine the effect of the additives on the cam and lifter wear in the valve train of an internal combustion engine at relatively high temperatures (about 149° C. bulk oil temperature during testing). The full Sequence IIID Test (64 hours) measures both wear and oxidation of the oil; however, since we are interested in valve train wear effects, and we know that the wear in the Sequence IIID Test occurs early in the test, we made use of the Sequence IIID Screener.

In this test, an Oldsmobile 350 CID engine was run under the following conditions:

Runs at 3000 rpm/max. run time for 8 hours and 100 pounds load;

Air/fuel* ratio=16.5/1, using *GMR Reference fuel (leaded);

Timing=31° BTDC;

Oil temperature=300° F.;

Coolant temperature in=235° F., out 245° F.;

30 in. of water of back pressure on exhaust;

Flow rate of jacket coolant=60 gal./min.;

Flow rate of rocker cover coolant=3 gal./min.;

Humidity must be kept at 80 grains of H2O;

Air temperature controlled equal inlet equal 80° F.;

Blow-by breather heat exchanger at 100° F.

The effectiveness of the additive is measured in terms of camshaft and lifter wear (see FIG. 1).

Examples 7–10

Bench Tests of Formulations without Alkylated Aminophenols

In addition to engine tests, various bench tests were carried out with the primary and secondary ZnDTPs. We report on the Falex Modified EP ASTM D 3233 here. The test blocks are placed in the jaws; the test pin is put in the spindle with shear pin in place. The test lubricant is placed in the pan and raised to the assembly to totally immerse the text specimens. Load is applied by a loading ratchet mechanism until the brass shear pin shears or the test pin breaks. The torque is reported in pounds from the gauge attached to the Falex lubricant tester.

The same lubricants were also tested in the Four Ball Load Wear Index (ASTM D 2783) and the Timken EP test (ASTM D 2782).

The results are shown in Table II.

TABLE II

| Example | % Secondary ZnDTP | Falex Torque (Lb) | Four Ball Load Wear Index (kg) | Timken EP (Lb) |
|---|---|---|---|---|
| 7 | 0 | 613 | 34.49/80/200** | <20/20* |
| 8 | 25 | 713 | 34.80/80/200 | <20/20 |

TABLE II-continued

| Example | % Secondary ZnDTP | Falex Torque (Lb) | Four Ball Load Wear Index (kg) | Timken EP (Lb) |
|---|---|---|---|---|
| 9 | 50 | 600 | 35.04/80/200 | <20/20 |
| 10 | 100 | 725 | 34.53/63/200 | <10/15 |

*Reporting the OK load and score load.
**Reporting initial scarring load, OK load, and weld load.

The lubricant contained varying amounts of secondary ZnDTP as shown in Table II on top of a baseline formulation of 8 wt % of a nitrogen-containing dispersant, 53 millimoles/kg Ca as calcium detergent, 0.7 Wt % of an oxidation inhibitor, and 7 wt % of an olefin copolymer V.I. improver in Exxon base oils.

Examples 11–14

Bench Tests of Formulations with Alkylated Aminophenols

The same Falex, Four Ball, and Timken EP bench tests were carried out with 0.5 wt % of the alkylated aminophenol added to the Samples 7–10. The results are shown in Table III.

TABLE III

| Results for the Addition of 0.5 Wt % Alkylated Aminophenol | | | | |
|---|---|---|---|---|
| Example | % Secondary ZnDTP | Falex Torque (Lb) | Four Ball Load Wear Index (kg) | Timken EP (Lb) |
| 11 | 0 | 687 | 41.48/100/200** | <20/20 |
| 12 | 25 | 787 | 34.0/80/200 | 10/15 |
| 13 | 50 | 525 | 29.2/63/200 | <20/20 |
| 14 | 100 | 1850 | 44.93/100/250 | <45/50 |

Example 15

Cost/performance effectiveness of the alkyl ZnDTPs is an important consideration when formulating oils. In the same reference from S. H. Roby of Lubrizol, Table IV shows that the end-of-test (EOT) viscosity increase for the all primary alkyl ZnDTP-containing formulation (Oil B) was less than for the primary alkyl, secondary alkyl ZnDTP-containing formulation (Oil A). Admittedly, both oils failed to meet the API SG specifications for viscosity increase at 40° C. and 64 test hours (375% maximum). However, Oil B showed less viscosity increase than Oil A (2400 versus 3300), even though it was not effective in reducing valve train wear.

TABLE IV

| | Sequence IIIE Engine Ratings for 64 Hour Tests* Engine Ratings | | | | | | |
|---|---|---|---|---|---|---|---|
| | Engine | Piston | Ring Land | Wear in Microns | | | EOT Viscosity |
| Lubricant | Sludge | Varnish | Deposits | Maximum | Minimum | Average | Increase |
| Oil A | 9.3 | 8.4 | 5.0 | 269 | 18 | 48 | 3300 |
| Oil B | 9.2 | 8.8 | 3.7 | 2985 | 8 | 447 | 2400 |

*S. H. Roby, "Investigation of Sequence IIIE Valve Train Wear Mechanisms," Lubr. Eng., 47, 5, pp 413–422 (1991).

The bench test data of Examples 11–14 and the data from S. H. Roby's paper suggest that two factors are important in determining ZnDTP performance: (1) Type and (2) Quantity of the individual ZnDTP. Evidently, successful formulations require a critical amount of individual ZnDTPs to provide adequate performance; i.e., the sum is not equal to its component parts.

SUMMARY

The data in Tables I, II, and III suggest that alkylated amino phenols represent an ashless approach to boosting the wear performance of a ZnDTP. In particular, when the oxidation inhibition properties of ZnDTPs are considered, we conclude that the best results are obtained when the oil formulation contains primary ZnDTP, where more than 50%, but less than 100%, of the alkyl groups of the ZnDTP are derived from primary alcohols.

While the present invention has been described with reference to specific embodiments, this application is intended to cover those various changes and substitutions that may be made by those skilled in the art without departing from the spirit and scope of the appended claims.

What is claimed is:

1. A lubricating oil composition comprising a major portion of at least one oil of lubricating viscosity, a minor portion of an alkylated aminophenol, and a minor portion of zinc dithiophosphate, wherein more than 50 mole % of the alkyl groups of the zinc dithiophosphate are derived from primary alcohols, wherein the alkylated aminophenol comprises a borated alkylated aminophenol.

* * * * *